US006907834B2

(12) United States Patent
Noguchi et al.

(10) Patent No.: US 6,907,834 B2
(45) Date of Patent: Jun. 21, 2005

(54) SEWING MACHINE

(75) Inventors: Yasukazu Noguchi, Nagoya (JP); Yasuhiko Kawaguchi, Nagoya (JP); Masato Kato, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/757,449

(22) Filed: Jan. 15, 2004

(65) Prior Publication Data

US 2004/0154507 A1 Aug. 12, 2004

(30) Foreign Application Priority Data

Jan. 22, 2003 (JP) ..... 2003-013346

(51) Int. Cl.[7] ..... D05B 65/00; D05B 87/02
(52) U.S. Cl. ..... 112/293; 112/225
(58) Field of Search ..... 112/163, 225, 112/285, 286, 253, 302, 293; 223/99; 83/856, 910, 913, 936, 950

(56) References Cited

U.S. PATENT DOCUMENTS 4,364,319 A * 12/1982 Niehaus et al. ..... 112/238
4,651,660 A * 3/1987 Oshima et al. ..... 112/225
5,088,426 A * 2/1992 Ogawa ..... 112/225
5,655,471 A * 8/1997 Tajima ..... 112/261
5,722,335 A * 3/1998 Kamewada et al. ..... 112/285
6,021,727 A * 2/2000 Ku ..... 112/286

FOREIGN PATENT DOCUMENTS

| | | |
|---|---|---|
| JP | A 51-24353 | 2/1976 |
| JP | A 9-23974 | 1/1997 |
| JP | A 9-299676 | 11/1997 |
| JP | A 2001-218992 | 8/2001 |

* cited by examiner

*Primary Examiner*—Ismael Izaguirre
(74) *Attorney, Agent, or Firm*—Oliff & Berridge

(57) ABSTRACT

A sewing machine includes a head on which a needle bar for fixing a needle is mounted, a thread cutting blade mounted in the head so as to be capable of cutting an end of a thread which is threaded so as to be passed through an eye of the needle, and a holder mounted in the head so as to be capable of holding the thread end after the thread end has been cut by the thread cutting blade. The thread cutting blade is positioned so that a first amount of thread from the eye of the needle mounted in the head to the thread end held by the holder equals a second amount of thread by which the thread end is drawn to an underside of a cloth in a stitch formed immediately after start of a sewing operation.

9 Claims, 11 Drawing Sheets

SEWING MACHINE

BACKGROUND OF THE INVENTION

1. Field of the Invention

This invention relates to sewing machines, and more particularly to a sewing machine in which a thread end is drawn to an underside of a cloth in a stitch immediately after start of sewing.

2. Description of the Related Art

There have conventionally been proposed sewing machines provided with threading means for automatically threading a sewing needle. For example, JP-8-173676-A discloses a technique for catching a thread by a hook having been passed through an eye of the needle and returning the hook through the needle eye such that the needle thread is passed through the needle eye, while the thread is guided by thread guide grooves or the like and held by thread holders. JP-51-24353-A discloses a first nipper holding a thread cut during the sewing and a second nipper catching the thread held by the first nipper. The thread caught by the second nipper is passed through the needle eye by a thread extruder. The thread having been passed through the needle eye is caught by a third nipper, which is then moved upward so that the thread is completely passed through the needle eye.

In the techniques disclosed in the above-noted documents, however, an end of the thread appears at the upper side of a cloth in a stitch immediately after start of sewing. Then, the operator needs to cut the thread end with scissors and draw the thread end to an underside of the cloth. Consequently, the operator is forced into useless labor and time.

SUMMARY OF THE INVENTION

Therefore, an object of the present invention is to provide a sewing machine in which the thread end can be drawn to the underside of the cloth in forming a stitch immediately after start of sewing.

The present invention provides a sewing machine comprising a head on which a needle bar for fixing a needle is mounted, a thread cutting blade provided in the head so as to be capable of cutting an end of a thread which is threaded so as to be passed through an eye of the needle, and a holder provided in the head so as to be capable of holding the thread end after the thread end has been cut by the thread cutting blade. In the sewing machine, the thread cutting blade is positioned so that a first amount of thread from the eye of the needle provided in the head to the thread end held by the holder equals a second amount of thread by which the thread end is drawn to an underside of a cloth in a stitch formed immediately after start of a sewing operation.

The operator cuts an end of a thread with the thread cutting blade in a threading operation and the thread end is held by the holder. In this case, a first amount of thread from the eye of the needle provided in the head to the thread end held by the holder equals a second amount of thread by which the thread end is drawn to an underside of a cloth in a stitch formed immediately after start of a sewing operation. Consequently, the thread end is drawn to the underside of the cloth when a stitch is formed immediately after start of a sewing operation.

The above-described sewing machine preferably further comprises a guide provided in the head for guiding the thread to the thread cutting blade. In this case, the thread cutting blade, the holder and the guide constitute a thread holding member.

The thread cutting blade is preferably positioned so that the first amount of thread is sufficient for the thread end to be prevented from being pulled through the needle eye in a stitch formed immediately after start of a sewing operation. In this construction, the sewing machine preferably further comprises a needle plate provided in a bed and having a needle hole. In this case, a distance between the needle eye and the thread cutting blade is longer than a distance between the needle eye and the needle hole of the needle plate.

The sewing machine preferably further comprises a threading hook and a threader threading the needle by the threading hook. In this construction, the thread set to be capable of being threaded is passed through the needle eye by the threading hook of the threader while the thread end is held by the holder.

Furthermore, the sewing machine preferably further comprises a thread drawer including a thread drawing member wiping the thread extending downward through the needle eye, the thread drawer drawing, by the thread drawing member, a looped thread having been passed through the needle eye by the threading hook, thereby disentangling the thread loop, the thread drawing member has a thread drawing stroke set so that the thread loop formed by passing the thread through the needle eye by the threading hook is drawn by the thread drawing member such that the thread is released from a looped state.

In the above-described construction, the sewing machine preferably further comprises a thread holder holding the thread drawn by the thread drawing member. In this case, an amount of thread extending from the needle eye to the thread end held by the holder is set so as to be approximately equal to an amount of thread extending from the needle eye to the thread end held by the thread holder.

Furthermore, the sewing machine preferably further comprises a plurality of needle bars and a plurality of the needles provided on the needle bars respectively. In this construction, the sewing machine preferably further comprises a needle bar case supporting the needle bars and a mounting base provided on the needle bar case. In this construction, the holder is fixed to the mounting base and the thread end is held between the mounting base and the holder after having been cut.

BRIEF DESCRIPTION OF THE DRAWINGS

Other objects, features and advantages of the present invention will become clear upon reviewing the following description of the invention with reference to the accompanying drawings, in which.

DETAILED DESCRIPTION OF THE INVENTION

One embodiment of the present invention will be described with reference to the drawings. In the embodiment, the invention is applied to an industrial or occupational multi-head sewing machine including three multi-needle embroidery sewing machines which can embroider three same embroidery patterns on respective caps at the same time.

Figure 1:
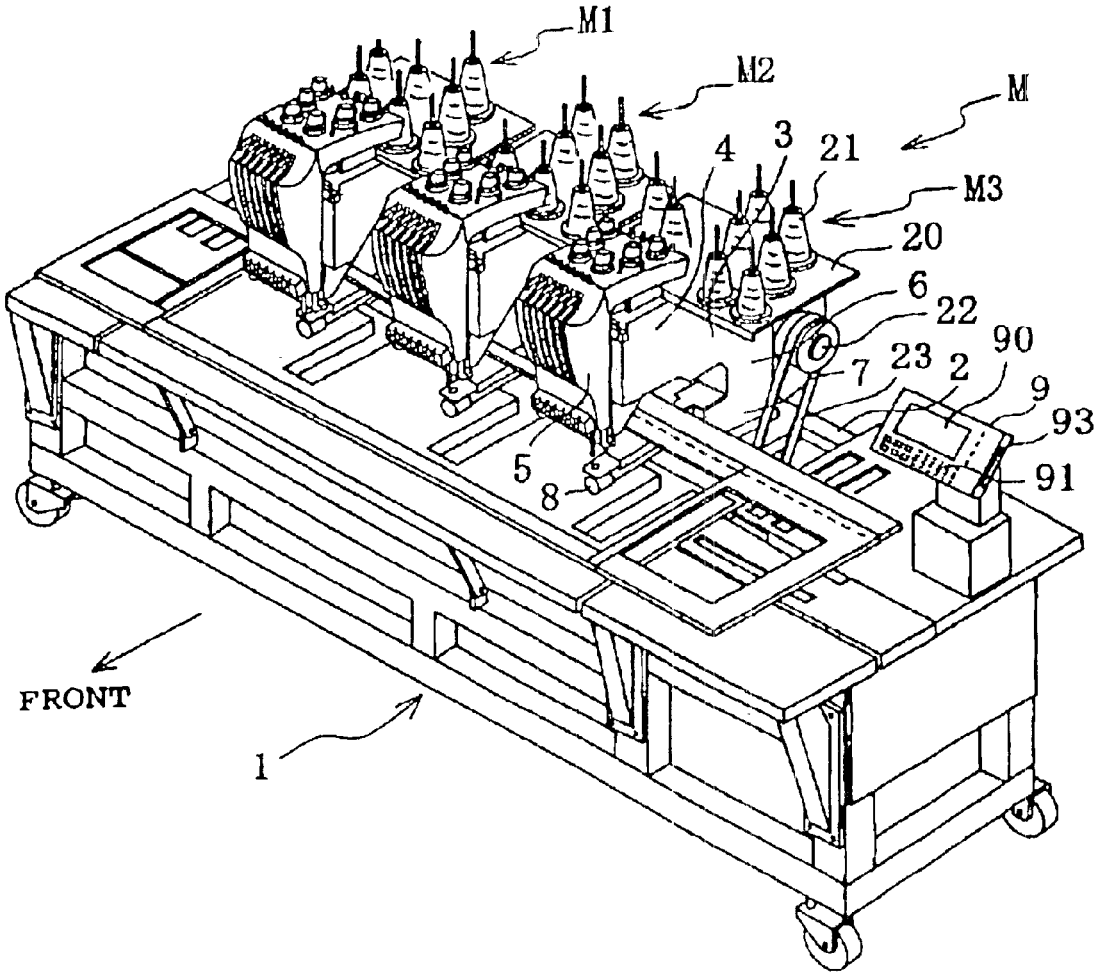
FIG. 1 is a perspective view of a multi-head sewing machine in accordance with one embodiment of the present invention.

The multi-head sewing machine M will first be described. Referring to FIG. 1, the multi-head sewing machine M comprises an embroidering machine body frame 1 extending in the right-and-left direction, and a generally rectangular machine support plate 2 mounted on the rear top of the frame 1 so as to extend in the right-and-left direction. Three multi-needle embroidery sewing machines M1 to M3 are mounted on the support plate 2 so as to be juxtaposed in the right-and-left direction. The embroidery sewing machines M1 to M3 have the same structure.

Each of the embroidery sewing machines M1 to M3 includes an arm 3 having a distal end on which a sewing head 4 is mounted. The head 4 has a front end on which a needle bar case 5 is mounted so as to be moved in the right-and-left direction. Six needle bars 10 are supported on the needle bar case 5 so as to be vertically moved. A sewing needle 15 having a needle eye 15*a* is fixed to each needle bar 10. A stud 6 is continuous to the arm 3 and has a lower end to which a sewing bed body 7 is continuous. The sewing bed body 7 is fixed to the machine support plate 2. The sewing bed body 7 has a front end from which a cylinder bed 8 extends forward. The cylinder bed 8 has a front end on which a thread loop taker (not shown) and the like are provided. The multi-head sewing machine M includes an operation panel 9 disposed at the right end thereof. An operator operates the operation panel 9 for execution of the sewing.

Figure 3:
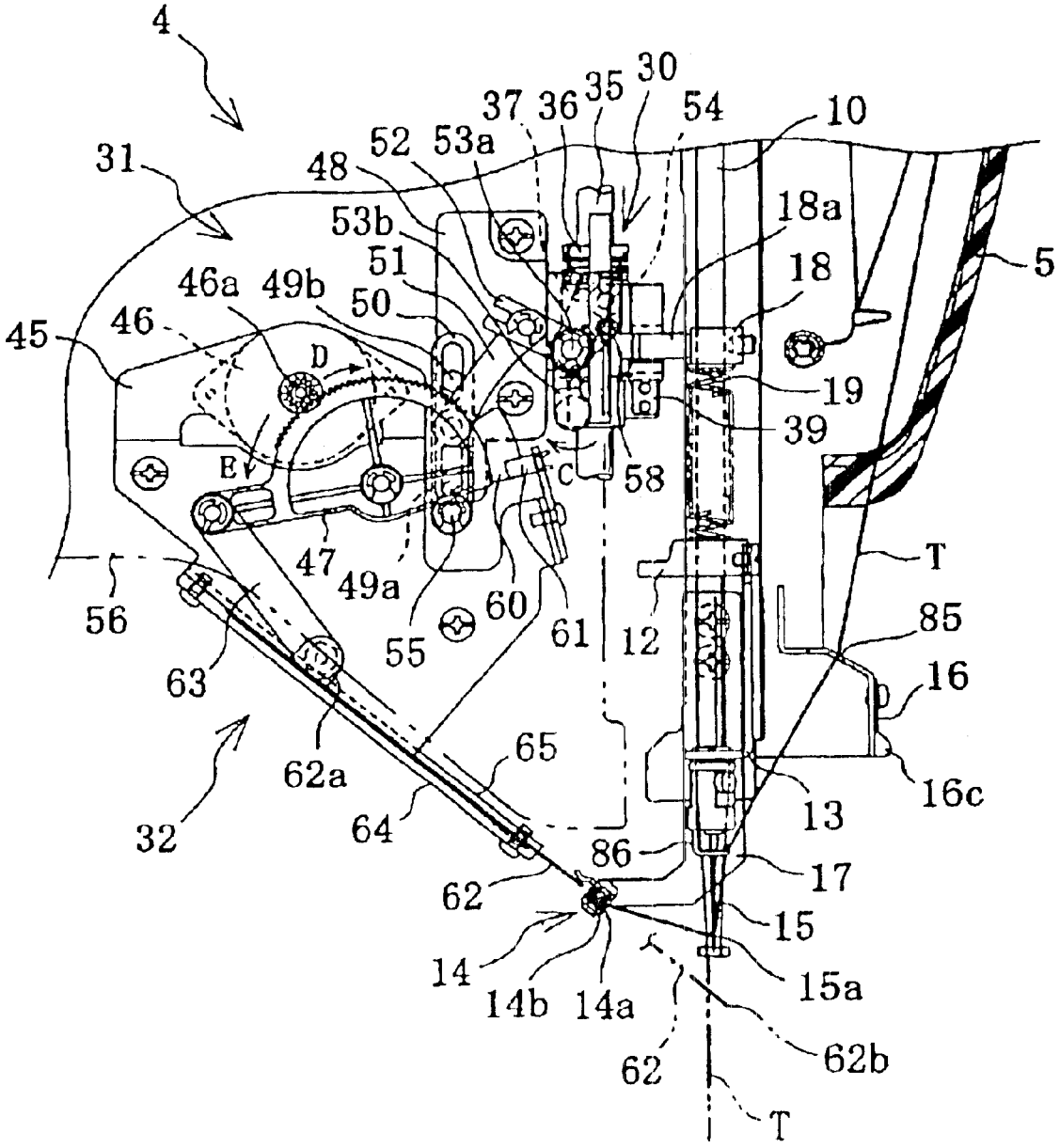
FIG. 3 is a partial left side view of an embroidery sewing machine.
Figure 4:
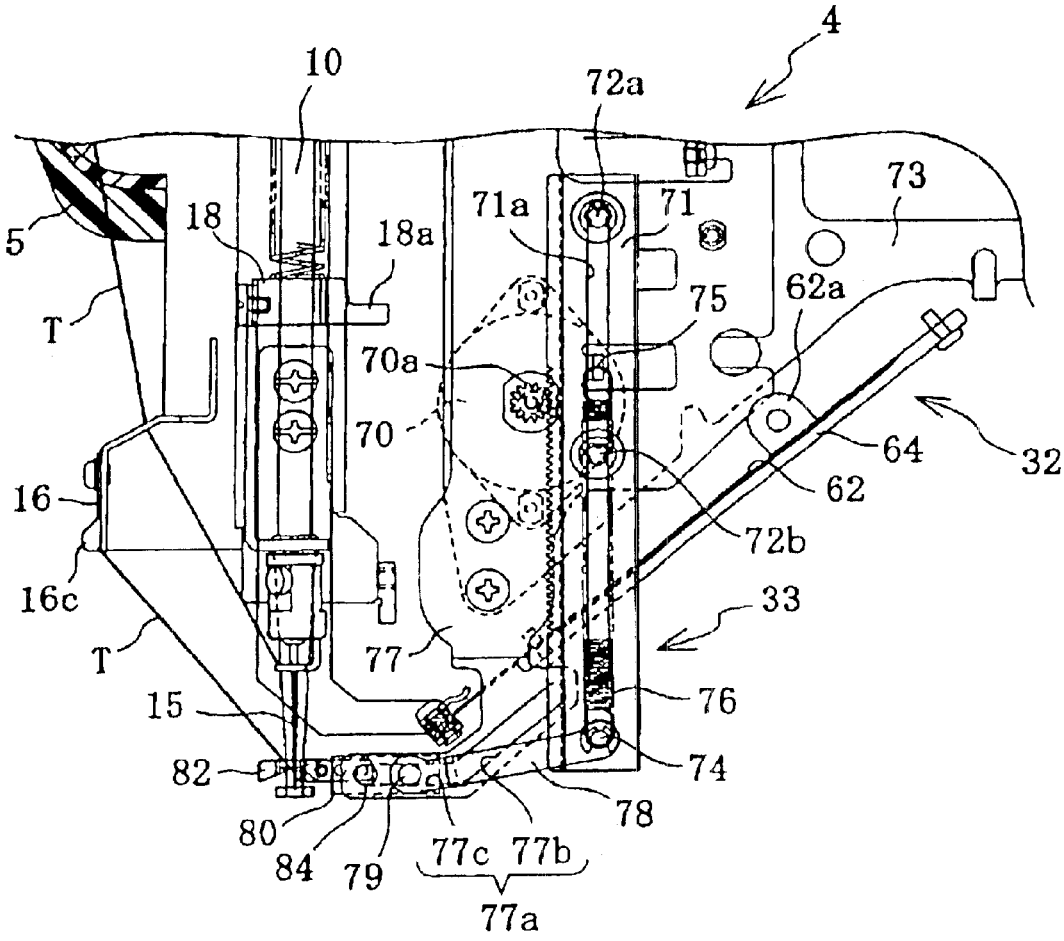
FIG. 4 is a partial right side view of the embroidery sewing machine.

Referring now to FIGS. 3 and 4, each head 4 includes the needle bar case 5, a lift driving mechanism 30 transmitting a vertically driving force from a sewing machine motor 110 to the needle bar 10 and a needle bar releasing mechanism 31 cutting off transmission of driving force between the needle bar 10 and the lift driving mechanism 30. Each head 4 further includes a thread drawing mechanism 32 further including a thread drawing member 62 and a threading mechanism 33 passing a thread through an eye 15*a* of a sewing needle 15 by means of a threading hook 83.

Figure 2:
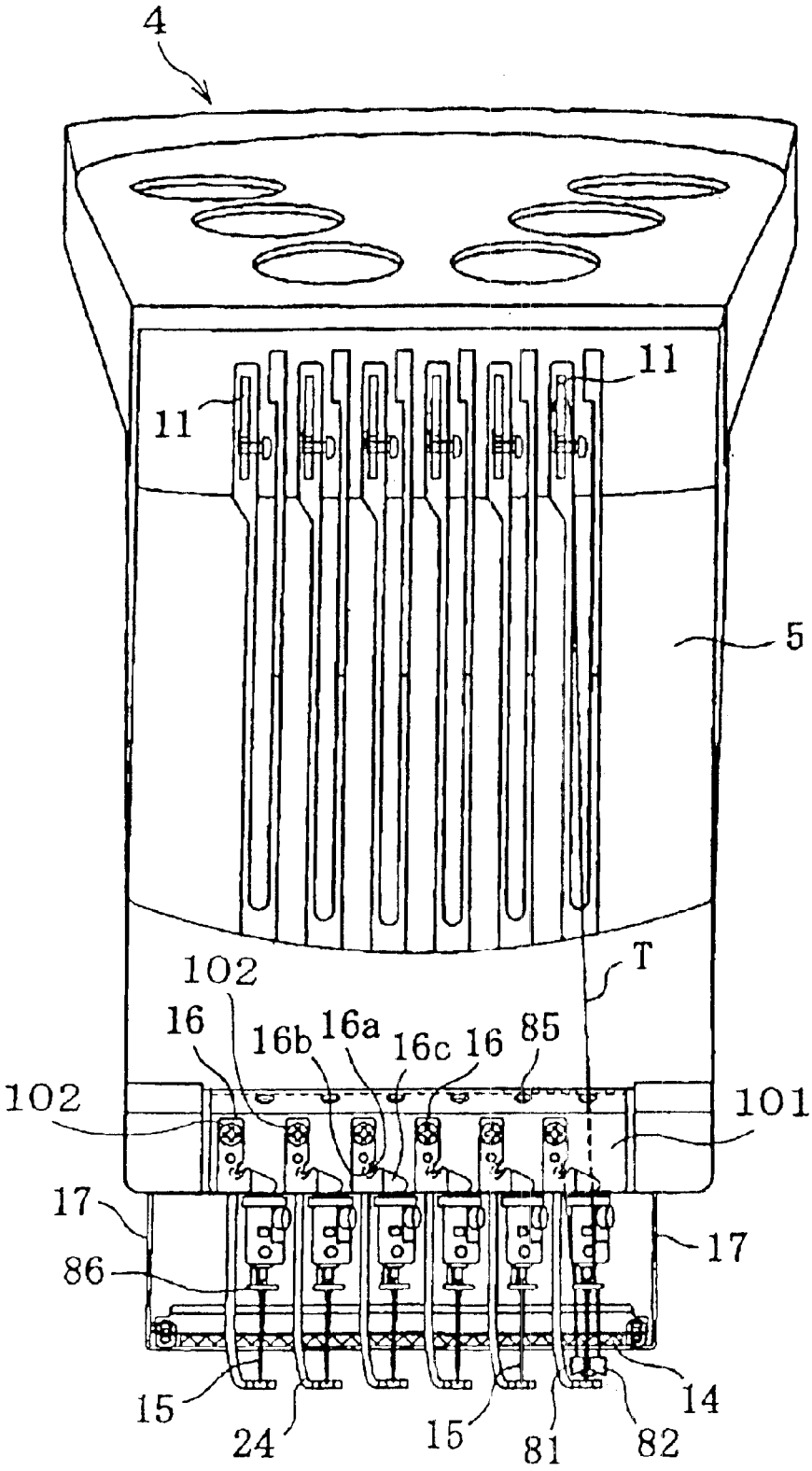
FIG. 2 is a front view of a needle bar case.

Referring to FIGS. 2 and 3, each needle bar case 5 includes six vertically extending needle bars 10, six needle thread take-ups 11 located so as to correspond to the respective needle bars 10 and attached so as to be swung. Each needle bar case 5 further includes first and second needle bar guiding members 12 and 13 both fixed to the needle bar case 5 to guide the needle bar 10 and a first thread holding member 14 extending in the right-and-left direction and supported on a fixing plate 17 having both ends secured to the needle bar case 5. Each needle bar case 5 still further includes six second thread holding members 16 disposed so as to correspond to the respective needles 15 and six presser feet 24 disposed so as to correspond to the respective needles 15.

A connecting member 18 is secured to a middle portion of each needle bar 10. The connecting member 18 includes a connecting pin 18*a* to which a driving force from the lift driving mechanism 30 is transmitted. A compression coil spring 19 is wound on the needle bar 10 between the connecting member 18 and the first needle bar guiding member 12. The compression coil spring 19 biases the needle bar 10 upward. The needles 15 are attached to the lower ends of the respective needle bars 10. An embroidering thread T is supplied from a thread spool 21 of a spool holder base 20 to each of the six needles 15.

The first thread holding member 14 holds the thread T drawn by the thread drawing mechanism 32. The first thread holding member 14 includes a thread holding tape 14*a* further including hook sides of two pieces of hook-type magic tape (registered trademark). The hook sides are superposed so as to confront each other. The first thread holding member 14 further includes a pair of reinforcing plates 14*b* holding the thread holding tape 14*a* therebetween.

Each second thread holding member 16 preliminarily holds a leading end of the thread T caught on the threading hook 83 before the thread T is passed through the needle eye 15*a*. The second thread holding member 16 includes a holding portion 16*a* holding the thread T cut by a thread cutting blade 16*a* and a guiding portion 16*c* having a forwardly protruding distal end and guiding the thread T to the holding portion 16*a*. The second thread holding member 16 is fixed by a screw 102 to a mounting base 101 mounted on the front of the needle bar case 5. The operator passes the thread T from the right side to the rear of the guiding portion 16*c*. When guided to the blade 16*a*, the thread T is drawn downwardly forward so that the thread T is cut by the blade 16*a* and held by the holding portion 16*b* and the front of the needle bar case 5 therebetween. Thus, the leading end of the thread T is held.

The thread T is drawn into the underside of a cloth by the needle 15 in a stitch formed immediately after start of the sewing operation. The thread T is caught by the thread loop taker, thereby being further drawn to the cloth underside. The thread cutting blade 16*a* is positioned so that an amount of thread drawn to the cloth underside in the above case is equal to an amount of thread by which the end of the thread T cut by the blade 16*a* is drawn into the cloth backside. In other words, the thread cutting blade 16*a* is positioned so that a first amount of thread from the eye 15*a* of the needle 15 provided in the head 4 to the thread end held by the holder 16*b* equals a second amount of thread T by which the thread end is drawn into an underside of a cloth in a stitch formed immediately after start of a sewing operation.

Furthermore, the thread cutting blade 16*a* is positioned so that when the needle 15 is moved downward in the forming of a stitch immediately after start of a sewing operation, the end of the thread T can be prevented from being pulled through the needle eye 15*a*. More specifically, a distance from the needle eye 15*a* to the blade 16*a* is set so as to be longer than a distance from the needle eye 15*a* to a needle hole of the needle plate mounted on the cylinder bed 8.

Each needle bar case 5 is moved right and left so that a desired one of the needles 15 is switched into a sewing position corresponding to a needle hole (not shown) formed in the distal end of the cylinder bed 8, whereby one of the needle bars 10 is selected. A rotating force developed by the motor 110 is transmitted via the driving shaft 22, a V belt and the like to the lift driving mechanism 30 as a vertically driving force. The lift driving mechanism 30 is then driven vertically so that the needle bar 10 is vertically moved and accordingly, the corresponding needle thread take-up 11 is vertically swung. Further, stitches are formed using the thread T with a selected color by the cooperation of the needle 15 of the needle bar 10 and the thread loop taker.

Figure 5:
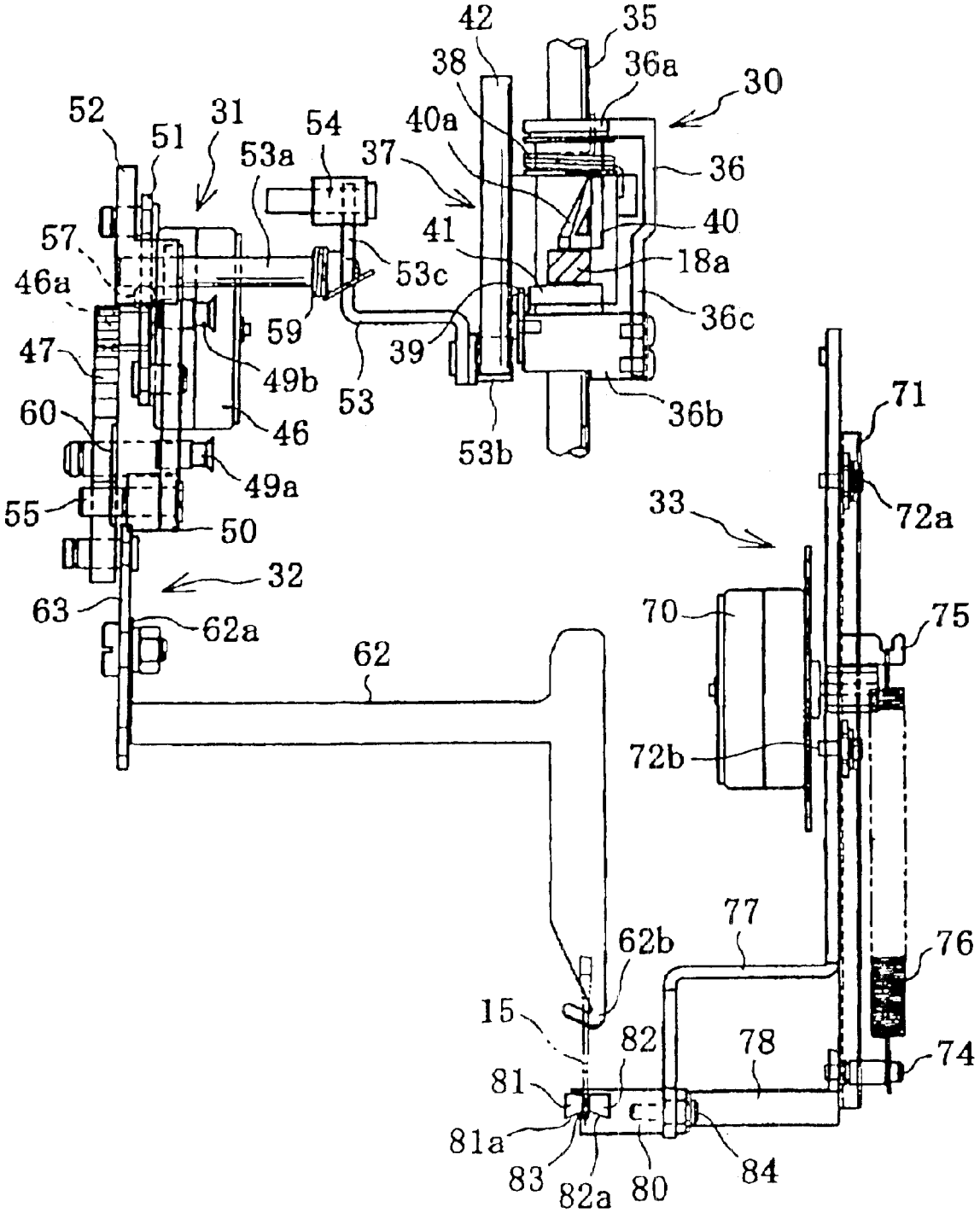
FIG. 5 is a partial front view of the embroidery sewing machine.
Figure 6:
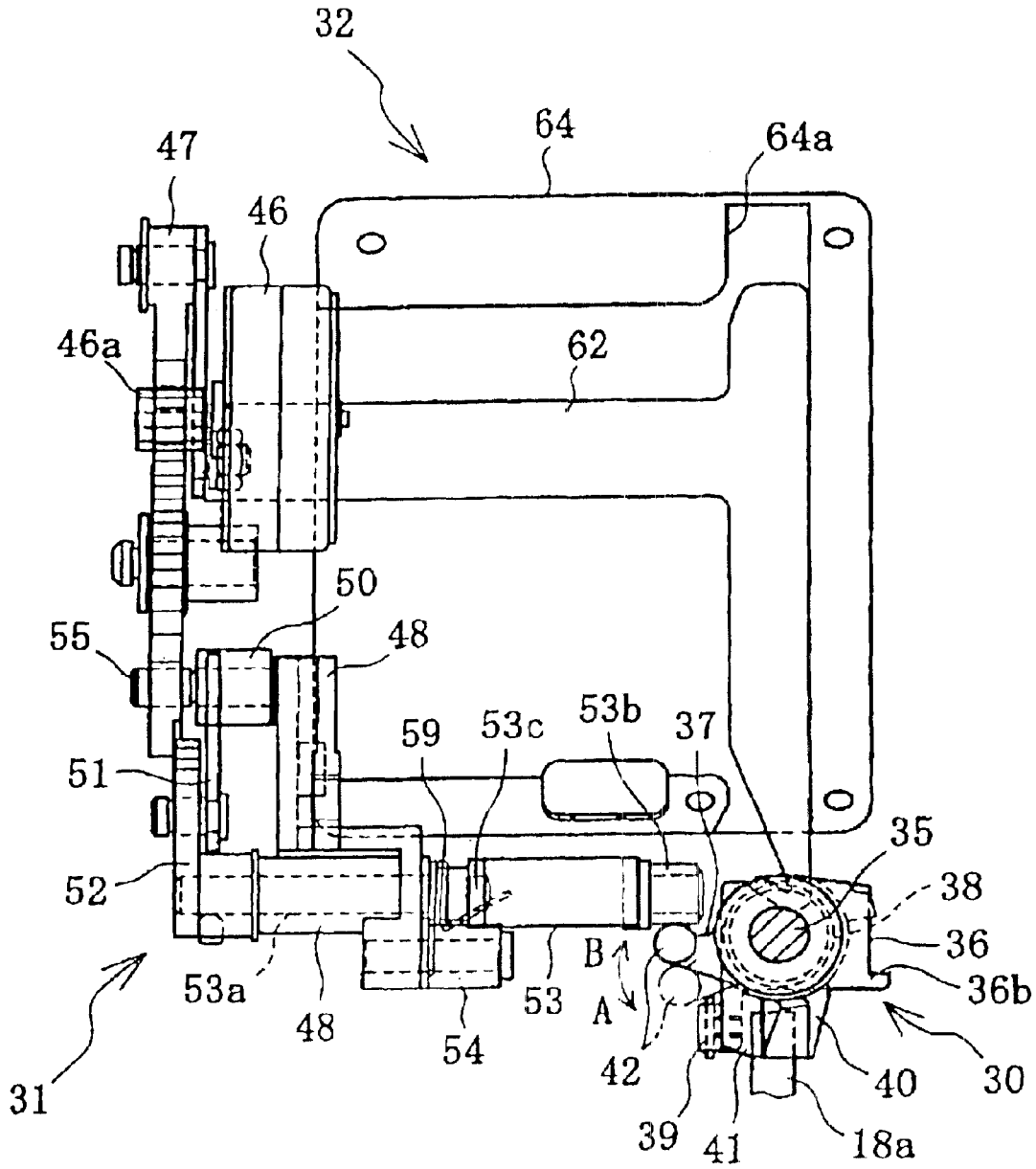
FIG. 6 is a partial plan view of the embroidery sewing machine.

Referring now to FIGS. 3, 5 and 6, the lift driving mechanism 30 includes a base needle bar 35 disposed in parallel with the needle bar 10 and a driving member 36 mounted on the base needle bar so as to be slidable and non-rotatable. The lift driving mechanism 30 further includes a transmitting member 37 mounted so as to be vertically driven together with the driving member 36 and so as to be rotatable relative to the base needle bar 35. The lift driving mechanism 30 still further includes a first coil spring 38 having one of two ends abutting the driving member 36 and the other end abutting the transmitting member 37 so that the transmitting member is biased to a transmitting position where the driving force is transmitted to the needle bar 10.

The driving member 36 includes upper and lower driving members 36*a* and 36*b* both fitted with the base needle bar 35 and a connecting portion 36*c* connecting the upper and lower driving members. A first coil spring 38 is fitted with the upper driving member 36*a*. A stopper 39 is secured to a left side of the lower driving member 36*b*. The stopper 39 limits rotation of the transmitting member 37 to a predetermined angle. The transmitting member 37 is disposed between the upper and lower driving members 36*a* and 36*b*. The transmitting member 37 includes first and second engaging members 40 and 41 engaging the connecting pin 18*a* and an abutment pillar 42 to which a rotating force from the needle bar releasing mechanism 31 is transmitted in order that the needle bar 10 may be released. The first engaging member 40 includes an inclined portion 40*a* turning the transmitting member 37 in the direction of arrow A in FIG. 6 when the connecting pin 18*a* in the released state abuts the first engaging member.

The needle bar releasing mechanism 31 includes a driving motor 46 mounted on the fixing member 45 and comprising a pulse motor and a sector gear 47 in mesh engagement with an output shaft 46*a* of the driving motor 46. The needle bar releasing mechanism 31 further includes a guided plate 50 guided by guide pins 49*a* and 49*b* secured to the fixing member 48 so that the guided member is vertically moved. The needle bar releasing mechanism 31 still further includes a first linking member 51 having a lower end connected to a central portion of the guided member 50 so that the lower end is swung and a second linking member 52 connected to an upper end of the first linking member 51 so as to be swung, an abutting member 53 swung with the second linking member 52 and a stopper 54 fixed to the fixing member 48. The sector gear 47 has a front half further having a lower end abutting an abutment pin 55 secured to a lower end of the guided plate 50. The fixing members 45 and 48 are fixed to a left-side sewing machine frame 56.

The abutting member 53 includes a shaft 53*a* rotatably mounted on the fixing member 48 and fixed to the second linking member 52 by a small screw 57, a first abutting portion 53*b* abutting the abutment pillar 42 of the transmitting member 37 and a second abutting portion 53*c* abutting the stopper 54. A second coil spring 59 is wound on a right end of the shaft 53*a*. The second coil spring 59 has one end fixed to a screw 58 in thread engagement with the fixing member 48. The abutting member 53 is biased in the direction of arrow C in FIG. 3 by the second coil spring 59 except when the needle bar 10 is jumped, whereupon the second abutting portion 53*c* is in abutment with the stopper 54.

In order that the needle bar 10 may be jumped to be released by the needle bar releasing mechanism 31, the driving motor 46 is driven so that the sector gear 47 is rotated in the direction of arrow D in FIG. 3, whereby the guided plate 50 is moved downward. The movement of the guided member 50 further moves the lower end of the first linking member 51 downward. With the downward movement of the first linking member 51, the second linking member 52 is rotated in the direction opposite arrow C about the shaft 53*a* together with the abutting member 53. By the rotation, the abutting member 53 presses the abutment pillar 42 of the transmitting member 37 which is further in abutment with the first abutting portion 53*b*, so that the transmitting member 37 is rotated in the direction of arrow A in FIG. 6 until the abutment pillar 42 abuts the stopper 39 (see the abutment pillar 42 shown by two-dot chain line in FIG. 6). As the result of rotation of the transmitting member 37, the first and second engaging members 40 and 41 are released from engagement with the connecting pin 18*a*. Consequently, the needle bar 10 is biased by the compression coil spring 19 thereby to be caused to jump to an upper limit position, whereby the needle bar 10 is in a released state in which a lifting force of the lift driving mechanism 30 is prevented from being transmitted to the needle bar 10.

On the other hand, in order that the needle bar 10 may be switched from the released state to a transmissible state in which the lift driving force of the lift driving mechanism 30 is transmissible to the needle bar, the transmitting member 37 is moved upward by the sewing machine motor 110 so that the connecting pin 18*a* abuts the inclined portion 40*a* from above, whereby the transmitting member 37 is rotated in the direction of arrow A in FIG. 6. Further, when moved upward so that the connecting pin 18*a* is located between the first and second engaging members 40 and 41, the transmitting member 37 is rotated in the direction of arrow B in FIG. 6 by the biasing force of the coil spring 38, whereby the connecting pin 18*a* engages the first and second engaging members 40 and 41 such that the needle bar 10 is in the transmissible state.

The thread drawing mechanism 32 wipes the thread T extending downward through the needle eye 15*a* when the thread has been cut by a thread cutting mechanism (not shown) provided in the cylinder bed 8 at the time of completion of the sewing or needle change. The thread drawing mechanism 32 further disentangles a loop L of thread which has been passed through the needle eye 15*a* and caught on the threading hook 83.

Referring to FIGS. 3, 5 and 6, the thread drawing mechanism 32 includes the driving motor 46, the sector gear 47 formed with a detected portion 60, a thread drawing member origin detector 61 for detecting the detected portion 60, and a thread drawing member 62. The thread drawing mechanism 32 further includes a coupling plate 63 having both ends coupled to the thread drawing member 62 and the sector gear 47 respectively so that the coupling plate 63 is swung. The thread drawing mechanism 32 still further includes a guiding member 64 guiding the thread drawing member 62 and a cover 65 for the guiding member 64. The thread drawing member 62 includes a standing portion 62*a* coupled to the coupling plate 63 so as to be swung and a hook 62*b* for drawing the thread T. The thread drawing member 62 is held between the guiding member 64 and the cover 65 and supported in a guide groove 64*a* formed in the guiding member 64 so that the thread drawing member 62 is slid.

The guide groove 64*a* guiding the thread drawing member 62 is formed so that the thread drawing member 62 is allowed to be further moved rearward from a standby position as shown in FIGS. 4 and 6 when the driving motor 46 is rotated in the direction of arrow D in FIG. 3 to drive the needle bar releasing mechanism 31. The origin detector 61 comprises a photo-interrupter including a light emitting element and a light detecting element. The origin detector 61 detects, as an origin, a position of the thread drawing member 62 when the lower edge of the detected portion 60 passes between the light emitting and detecting elements.

In wiping the thread, the sector gear 47 to which the driving force is transmitted from the driving motor 46 is rotated in the direction of arrow E in FIG. 3. With the rotation of the motor 46, the coupling plate 63 is moved downwardly forward so that the thread drawing member 62 coupled to the lower end of the coupling plate 63 passes through the first thread holding member 14 while being guided by the guide groove 64*a*. Thus, the thread drawing member 62 is slid to the thread wiping position where the hook 62*b* is located below the needle 15. The hook 62*b* is engaged with the thread T which extends downward after having been passed through the needle eye 15*a* (see two-dot chain line in FIG. 3). When the thread drawing member 62 is returned to the standby position in the aforesaid state, the thread T in engagement with the thread drawing member 62 is held by the thread holding tape 14*a* of the first thread holding member 14 when passing through the first holding member.

Referring now to FIGS. 4 and 5, the threading mechanism 33 includes a threading motor 70 comprising a pulse motor, a rack 71 meshed with an output shaft 70*a* of the threading motor 70 and having a guide groove 71*a* which is engaged with guide pins 72*a* and 72*b* fixed to the right machine frame 73, and an extension spring 76 having two ends. One end of the extension spring 76 is connected to a connecting pin 74 fixed to a lower end of the rack 71 and the other end of the extension spring 76 is connected to a connecting protrusion 75 fixed to a guide frame 77. As a result, the extension spring 76 urges the rack 71 upward. The threading mechanism 33 further includes the guide frame 77 fixed to the right machine frame 73 and formed with a guide groove 77*a*, a crank plate 78 located on the right of the guide frame 77 and connected via the connecting pin 74 to a lower end of the rack 71, and a link block 80 formed into the shape of a rectangular parallelepiped. A first guided pin 79 is engaged with a guide groove 77*a* formed in a lower end of the crank plate 78. The link block 80 is connected via the first guided pin 79 to a left side of the guide frame 77 so as to be swung. The threading mechanism 33 still further includes a pair of right and left thread catching members 81 and 82 fixed to a distal end of the link block 80 and having inclined portions 81*a* and 82*a* both guiding the thread T to the threading hook 83. The threading hook 83 has a hook 83*a* (see FIG. 9) on which the thread T held between the thread catching members 81 and 82 is caught. A threading hook detector (not shown) detects a position of the threading hook 83.

A second guided pin 84 engaged with the guide groove 77*a* is fixed to a middle portion of the link block 80. The guide groove 77*a* includes an inclined portion 77*b* and a horizontal portion 77*c*. In the threading operation, the link block 80 is firstly guided downwardly forward and horizontally forward subsequently.

Figure 7:
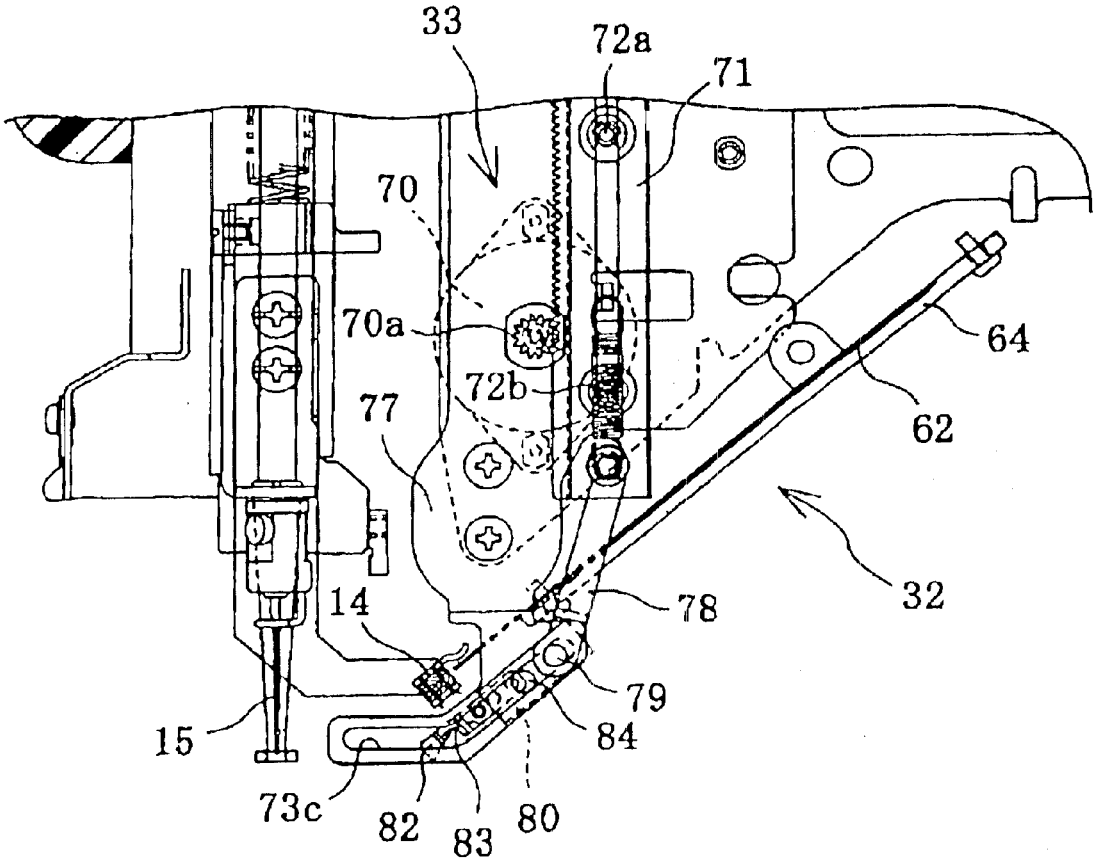
FIG. 7 is a right side view of the embroidery sewing machine, showing a stage of a threading operation.
Figure 9:
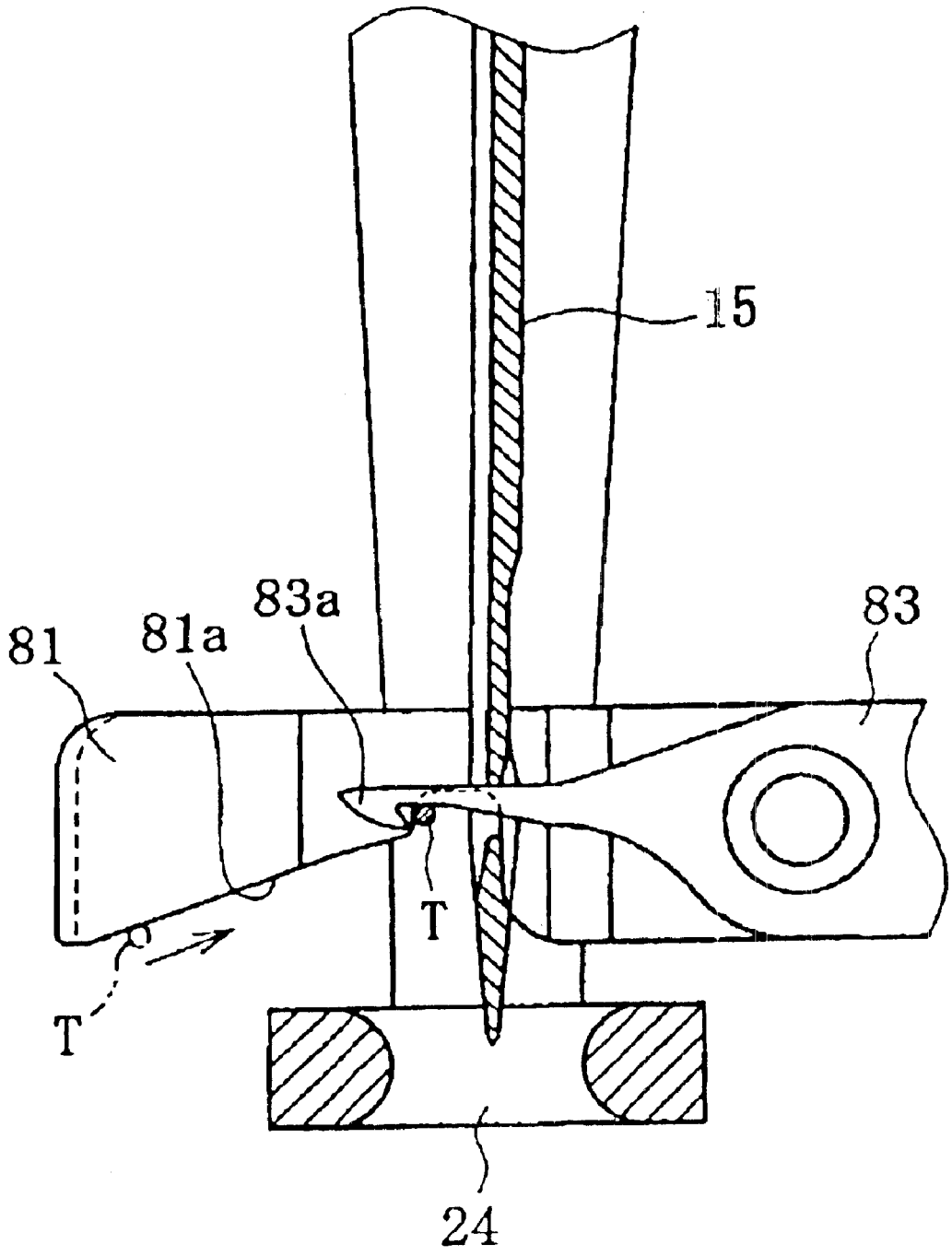
FIG. 9 is a longitudinal section of a sewing needle and its periphery in the threaded state.

A threading operation by the thread drawing mechanism 32 and the threading mechanism 33 will now be described. FIG. 7 illustrates the threading hook 83 and the thread drawing member 62 both of which are in the standby state. In this state, when the operator operates a threading switch (not shown) provided on the operation panel 9, the threading motor 70 is driven to move the rack 71 downward while the rack 71 is being guided by the guide pins 72*a* and 72*b*. As a result the crank plate 78 connected to the rack 71 and the link block 80 connected to the crank plate 78 are firstly moved downwardly forward along the inclined portion 77*b* of the guide groove 77*a* and subsequently horizontally forward along the horizontal portion 77*c*. Further, the link block 80 is moved so that the hook portion 83*a* of the threading hook 83 passes through the needle eye 15*a* as shown in FIGS. 4 and 9. The link block 80 is stopped at a thread catching position where the second guided pin 84 abuts the front end of the guide groove 77*a*.

Figure 10:
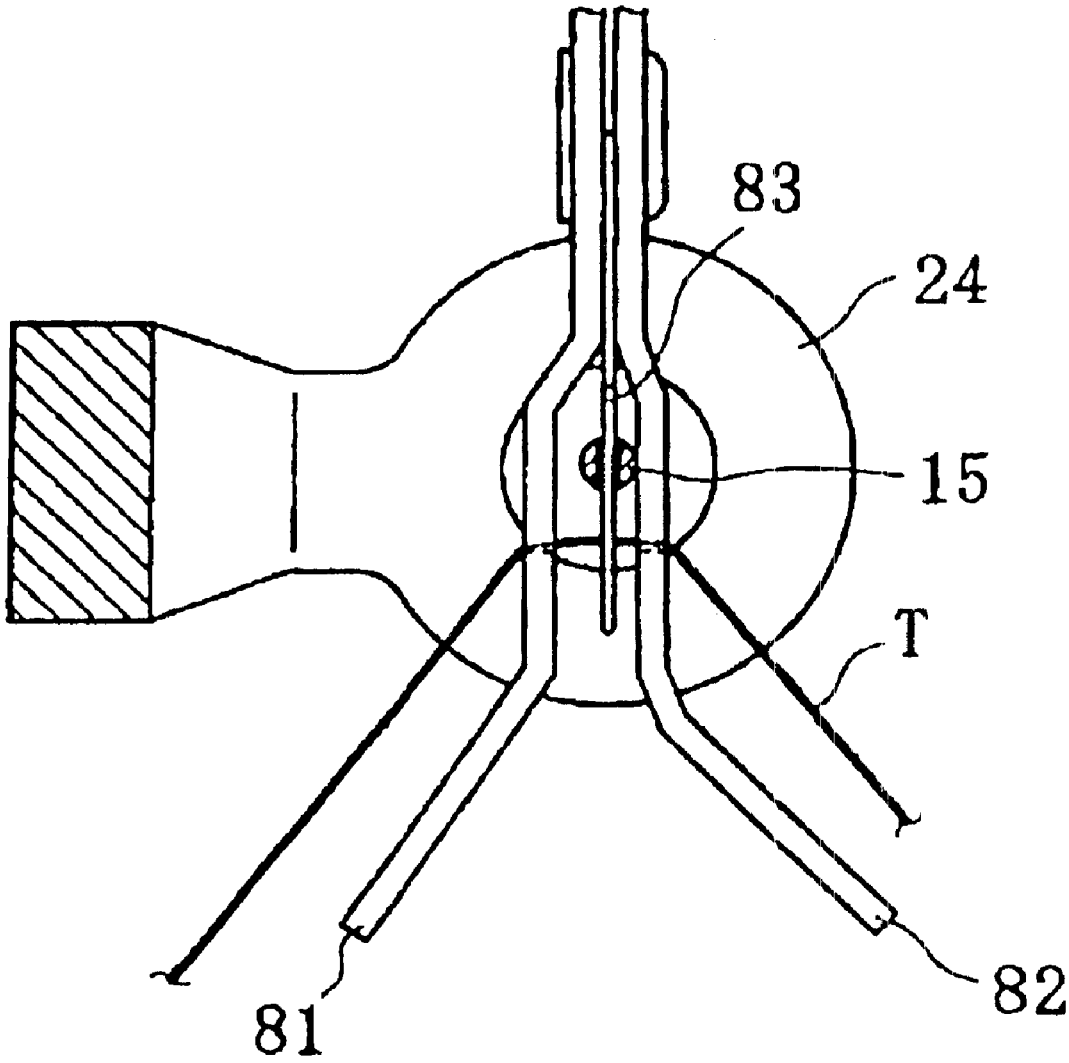
FIG. 10 is a plan view of a sewing needle and its periphery in the threaded state.

Referring to FIGS. 2 and 4, the operator sets the thread T guided by the thread guides 85 and 86 and the like, on the thread catching members 81 and 82 from the right side. The thread T is then cut by the blade 16*a* of the second thread holding member 16. A free end of the thread T is held between the holding portion 16*b* and front face of the needle bar case 5, whereby the thread T is held. In this case, when the operator upwardly draws the thread T caught on the thread catching members 81 and 82, the thread T is guided to the threading hook 83 by the inclined portions 81*a* and 82*a* of the respective thread catching members to be caught on the hook portion 83*a*, as shown in FIGS. 9 and 10.

Figure 8:
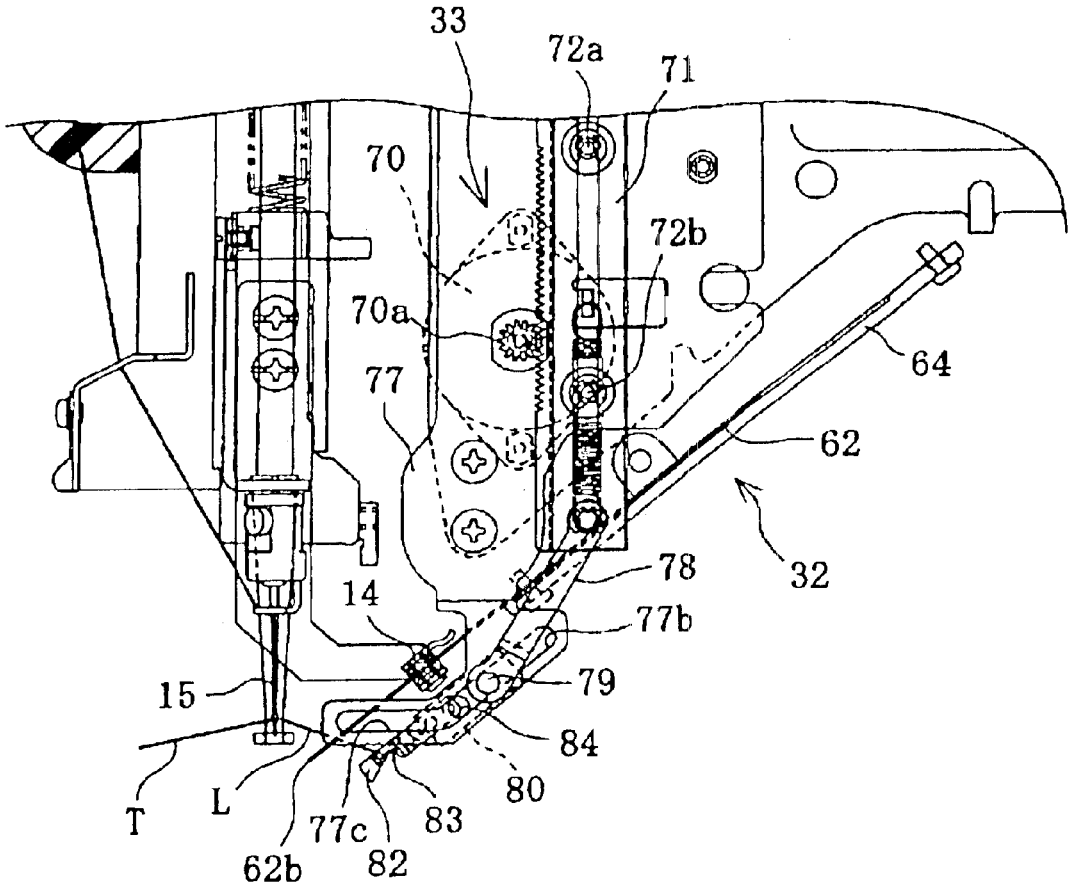
FIG. 8 is also a right side view of the embroidery sewing machine, showing another stage of the threading operation.

Subsequently, when the operator re-operates the threading switch, the threading motor 70 is driven to move the threading hook 83 rearward by a predetermined distance. The threading hook 83 is stopped at a loop disentangling position located in the rear of the needle 15. When the driving motor 46 is then rotated in the direction of arrow E in FIG. 3 and the thread drawing member origin detector 61 detects the origin of the thread drawing member 62, a predetermined number of pulses is supplied to the driving motor 46 so that the thread drawing member 62 is moved to the thread drawing position along the same locus as that in the thread wiping operation, as shown in FIG. 8. Consequently, the hook portion 62*b* of the thread drawing member 62 is passed through the thread loop L and the free end side F of the thread loop engages the hook portion 62*b*.

In this case, a distance by which the thread drawing member 62 is moved from the stand by position to the thread drawing position is referred to as "thread drawing stroke." The end of the thread T cut by the blade 16*a* of the second thread holding member 16 includes a thread loop formed by a part of the thread T extending from the needle eye 15*a* and held by the thread holding portion 16*b*. The aforesaid thread drawing stroke is set so that the thread T is released from a looped state. More specifically, the thread drawing stroke is set so as to be a distance corresponding to an approximately half of an amount of thread from the needle eye 15*a* to the thread holding portion 16*b*.

Figure 11:
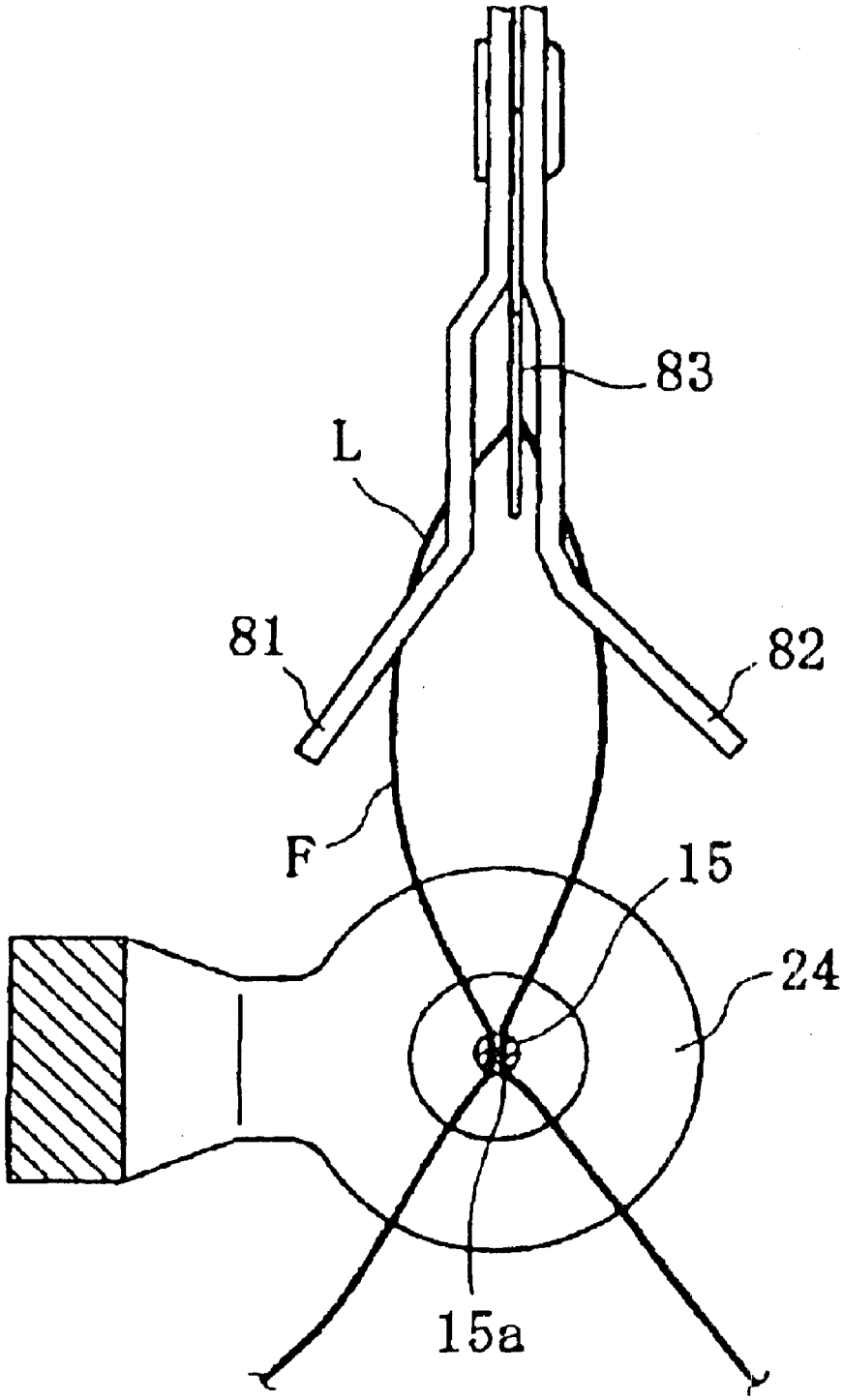
FIG. 11 is a plan view of the sewing needle and its periphery with a thread loop being formed.

At this time, the thread T is loosened when the free end of the thread T is released from the holding by the second thread holding member 16. Further, the thread loop L engages the threading hook 83. Accordingly, the width of the thread loop L in the right-and-left direction is increased without the thread loop hanging down between the threading hook 83 and the needle eye 15*a*, as shown in FIG. 11. Further, since the hook 83*a* is located lower than the needle eye 15*a*, the thread loop L is substantially perpendicular to the thread drawing member 62, as shown in FIG. 8. Consequently, the thread drawing member 62 is passed through the loop L and engaged with the thread T.

Subsequently, when the thread drawing member 62 is returned to the standby position by the driving motor 46, the free end side F of the thread loop L held between the threading hook 83 and the needle eye 15*a* is drawn so that the thread loop L is pulled back through the needle eye 15*a* and disengaged from the threading hook 83. Consequently, the thread forming the loop L is released from the looped state. Further, the thread T is held by the thread holding tape 14*a* of the first thread holding member 14 when the thread drawing member 62 passes the first thread holding member 14 while drawing the free end side F of the thread T. Thus, the thread T is completely passed through the needle eye 15*a*. Subsequently, the threading motor 70 is driven to return the threading hook 83 to the standby position, whereby the threading operation is completed.

On the other hand, the operation panel 9 is operated so that various commands concerning the sewing or the like are supplied. The operation panel 9 includes a display 90, input means 91 including a threading switch and the like and a flexible disc drive (FDD) 93.

The following effects can be achieved from the above-described multi-head sewing machine M. The thread T is drawn into the underside of a cloth by the needle 15 in a stitch formed immediately after start of the sewing operation. The thread T is caught by the thread loop taker, thereby being further drawn into the cloth underside. The thread cutting blade 16*a* is positioned so that an amount of thread drawn into the cloth underside in the above case is equal to an amount of thread by which the end of the thread T cut by the blade 16*a* is drawn to the cloth backside. Accordingly, the end of the thread T is prevented from coming out of the surface of the cloth to be sewn. Consequently, since the operator need not cut the end of the thread T and draw the thread end to the underside of the cloth, an amount of useless labor and an amount of useless time can be reduced.

Furthermore, the thread cutting blade 16*a* is positioned so that when the needle 15 is moved downward in the forming of a stitch immediately after start of a sewing operation, the end of the thread T can be prevented from being pulled through the needle eye 15*a*. Consequently, since the thread T can be prevented from being pulled through the needle eye 15*a*, an amount of useless labor and an amount of useless time both due to a re-threading operation can be reduced.

Further, the end of the thread T cut by the blade 16*a* of the second thread holding member 16 includes a thread loop formed by a part of the thread T extending from the needle eye 15*a* and held by the thread holding portion 16*b*. The thread drawing stroke of the thread drawing member 62 is set so that the thread forming the loop L is released from the looped state. Consequently, since the operator need not release the thread forming the loop L manually, an amount of useless labor and an amount of useless time can be reduced.

Additionally, each sewing head 4 is provided with a plurality of needle bars 10 (six needle bars, in the embodiment) and the needle bars 10 are provided with the respective needles 15. Consequently, a plurality of types of embroidery threads can be used in the sewing.

Several modified forms of the foregoing embodiment will now be described. In the foregoing embodiment, the present invention is applied to the embroidery sewing machines M1 to M3 each of which is provided with the needle bar case 5 in which a plurality of needles 15 and needle bars 10 are mounted on the single head 4. However, the invention may be applied to a sewing machine comprising a single head provided with a single sewing needle.

The invention is applied to the industrial or occupational multi-head sewing machine M in the foregoing embodiment. However, the invention may be applied to a household sewing machine for personal use.

The lift driving mechanism 30 and the driving force transmitting means are inseparable from the cloth moving mechanism in the foregoing embodiment. However,the cloth moving mechanism maybe separable from the lift driving mechanism 30 and the driving force transmitting means as disclosed in Japanese Patent No. 3178022.

In the foregoing embodiment, the threading hook 83 and the thread drawing member 62 are located in the rear of the needle 15. However, either one or both of the threading hook and thread drawing member may be disposed in front of the needle or side by side.

In the foregoing embodiment, the thread drawing member 62 passes through the thread loop L and then engages the thread T while the threading hook 83 and the thread T are in engagement with each other. However, the thread drawing member 62 may engage the thread loop while the threading hook and the thread are disengaged from each other.

The thread T is held between the thread holding tapes 14*a* of the first thread holding member 14 in the foregoing embodiment. However, unless the thread is inadvertently moved or if the thread can be released from the holding by the first thread holding member upon sewing, the thread may merely be placed on a member thereby to be held. Further, upon start of sewing, the thread T is drawn by the needle 15 without operation of the first thread holding member 14, so that the thread is released from the held state. However, the first thread holder may comprise an actuator so that the thread is released in a positive manner, instead.

The thread drawing member 62 is reciprocally moved along a linear passage in the foregoing embodiment. However, the thread drawing member may reciprocally be moved along an arc passage or may be moved in one way along a passage. In the foregoing embodiment, the distance by which the thread drawing member 62 is moved for disentanglement of the thread loop L is shorter than that thereof for thread wiping. However, the thread drawing member 62 is moved along a linear passage both for disentanglement of the thread loop L and for thread wiping. Two linear passages may be provided both for disentanglement of the thread loop L and for thread wiping respectively.

In the foregoing embodiment, the invention is applied to the multi-head sewing machine M in which the operator is located in front of the sewing machine in the sewing as viewed in FIG. 1. However, the invention may be applied to a single-head sewing machine or the like in which the operator is located on the right or left of the sewing machine. Since the position of the operator changes in this sewing machine, it is desirable that the threading hook and the thread drawing member are moved along a track differing from the one in the foregoing embodiment, for example, so that the tracks of the threading hook and the thread drawing member are moved toward the operator.

An article to be sewn is moved by a cylindrical cap frame in the above-described multi-head sewing machine M. However, the invention may be applied to a sewing machine in which an article to be sewn is moved by a flat embroidery frame. Further, the invention may be applied to a sewing machine which is not provided with any embroidery frame and an article to be sewn is moved by a feed dog, by a feed roller or manually.

The free end side F of the thread loop L is located on the left of the needle 15 in the foregoing embodiment as shown in FIG. 11. Accordingly, the hook 62*b* of the thread drawing member 62 is open to the left side. However, the free end side of the thread loop may be located on the right of the needle so that the hook of the thread drawing member is open to the right side, instead.

The thread cutting blade 16*a* and the holding portion 16*b* of the second thread holding member 16 are formed substantially at the same position in the foregoing embodiment. The thread cutting blade and the holding portion holding the cut thread may be discrete from each other or located at locations differing from each other.

The thread cutting blades 16*a* of the second thread holding members 16 are provided on the front of each needle bar case 5 so as to correspond to a plurality of needles 15 respectively in the foregoing embodiment. However, the thread cutting blades may be provided on the head so that a predetermined amount of thread is obtained, instead.

The thread cutting blades 16*a* of the second thread holding members 16 are provided so as to correspond to the respective needles 15 in the foregoing embodiment. However, a single thread cutting blade may be provided so as to be moved in the right-and-left direction.

The pulse motor is used as the drive motor 46 in the foregoing embodiment. Another type of motor, a solenoid or an air cylinder may be used as the drive motor, instead.

The position of each second thread holding member 16 may be adjustable so that the distance from each second thread holding member to the corresponding needle 15 is individually changed. Consequently, an optimum distance can be set for every needle according to a type of the thread or the like.

The above-described multi-head sewing machine M includes the sewing bed 7 having a cylinder bed 8. However, the sewing bed may have a flat bed.

The foregoing description and drawings are merely illustrative of the principles of the present invention and are not to be construed in a limiting sense. Various changes and modifications will become apparent to those of ordinary skill in the art. All such changes and modifications are seen to fall with in the scope of the invention as defined by the appended claims.

We claim:

1. A sewing machine comprising:

a head on which a needle bar for fixing a needle is mounted;

a thread cutting blade provided in the head so as to be capable of cutting an end of a thread which is threaded so as to be passed through an eye of the needle; and a holder provided in the head so as to be capable of holding the thread end after the thread end has been cut by the thread cutting blade, wherein the thread cutting blade is positioned so that a first amount of thread from the eye of the needle provided in the head to the thread end held by the holder equals a second amount of thread by which the thread end is drawn to an underside of a cloth in a stitch formed immediately after start of a sewing operation.

2. A sewing machine according to claim 1, further comprising a guide provided in the head for guiding the thread to the thread cutting blade, wherein the thread cutting blade, the holder and the guide constitute a thread holding member.

3. A sewing machine according to claim 1, wherein the thread cutting blade is positioned so that the first amount of thread is sufficient for the thread end to be prevented from being pulled through the needle eye in a stitch formed immediately after start of a sewing operation.

4. A sewing machine according to claim 3, further comprising a needle plate provided in a bed and having a needle hole, wherein a distance between the needle eye and the thread cutting blade is longer than a distance between the needle eye and the needle hole of the needle plate.

5. A sewing machine according to claim 1, further comprising a threading hook and a threader threading the needle by the threading hook, wherein the thread set to be capable of being threaded is passed through the needle eye by the threading hook of the threader while the thread end is held by the holder.

6. A sewing machine according to claim 5, further comprising a thread drawer including a thread drawing member wiping the thread extending downward through the needle eye, the thread drawer drawing, by the thread drawing member, a looped thread having been passed through the needle eye by the threading hook, thereby being released from a looped state, the thread drawing member has a thread drawing stroke set so that the thread loop formed by passing the thread through the needle eye by the threading hook is drawn by the thread drawing member such that the thread is released from the looped state.

7. A sewing machine according to claim 5, further comprising a thread holder holding the thread drawn by the thread drawing member, wherein an amount of thread extending from the needle eye to the thread end held by the holder is set so as to be approximately equal to an amount of thread extending from the needle eye to the thread end held by the thread holder.

8. A sewing machine according to claim 1, further comprising a plurality of needle bars and a plurality of the needles provided on the needle bars respectively.

9. A sewing machine according to claim 8, further comprising a needle bar case supporting the needle bars and a mounting base provided on the needle bar case, wherein the holder is fixed to the mounting base and the thread end is held between the mounting base and the holder after having been cut.

* * * * *